US010866021B2

(12) United States Patent
Okazaki et al.

(10) Patent No.: US 10,866,021 B2
(45) Date of Patent: Dec. 15, 2020

(54) HEAT-INSULATION BOX

(71) Applicant: Panasonic Corporation, Osaka (JP)

(72) Inventors: Toru Okazaki, Osaka (JP); Baiyu Liu, Osaka (JP); Terutsugu Segawa, Osaka (JP); Yasuhiro Asaida, Kyoto (JP)

(73) Assignee: PANASONIC CORPORATION, Osaka (JP)

( * ) Notice: Subject to any disclaimer, the term of this patent is extended or adjusted under 35 U.S.C. 154(b) by 0 days.

(21) Appl. No.: 15/684,727

(22) Filed: Aug. 23, 2017

(65) Prior Publication Data

US 2018/0073799 A1 Mar. 15, 2018

(30) Foreign Application Priority Data

Sep. 9, 2016 (JP) ..... 2016-176089
May 25, 2017 (JP) ..... 2017-103643

(51) Int. Cl.
*F25D 21/04* (2006.01)
*F25D 23/06* (2006.01)

(52) U.S. Cl.
CPC ..... *F25D 23/069* (2013.01); *F25D 21/04* (2013.01); *F25D 2201/124* (2013.01); *F25D 2201/126* (2013.01); *F25D 2400/04* (2013.01)

(58) Field of Classification Search
CPC ..... F25D 21/04; F25D 23/069; F25D 2400/04
See application file for complete search history.

(56) References Cited

U.S. PATENT DOCUMENTS 5,888,329 A * 3/1999 Cho ..... B32B 5/24 156/93
2003/0157284 A1 8/2003 Tanimoto et al.
2012/0112388 A1* 5/2012 Kim ..... C01B 33/159 264/419
2013/0142983 A1* 6/2013 Han ..... B32B 5/26 428/69
2013/0344279 A1 12/2013 Doshi et al.

FOREIGN PATENT DOCUMENTS

CN 104603344 A 5/2015
JP 4-103984 4/1992
JP 10062054 * 3/1998
(Continued)

OTHER PUBLICATIONS

Chinese Search Report dated Jul. 2, 2020 for the related Chinese Patent Application No. 201710599070.7.

*Primary Examiner* — Eric S Ruppert
(74) *Attorney, Agent, or Firm* — McDermott Will & Emery LLP

(57) ABSTRACT

A heat-insulation box, includes: a heat-insulation-box main body that has a space; a door that seals the space; and a partition plate that partitions the space, wherein the partition plate includes (i) a design plate that is placed at a side of the door, (ii) a first plate part and a second plate part that are each provided at both edges of the design plate, (iii) a heat-insulation material that is located in a region surrounded by the design plate, the first plate part, and the second plate part, and (iv) a heat-insulation member that is placed in at least one of a gap between the design plate and the first plate part, and a gap between the design plate and the second plate part.

13 Claims, 13 Drawing Sheets

(56) References Cited

FOREIGN PATENT DOCUMENTS

| | | | | |
|---|---|---|---|---|
| JP | 10318657 | A | * | 12/1998 |
| JP | 2945553 | B | | 9/1999 |
| JP | 2000046462 | | * | 2/2000 |
| JP | 2002267328 | A | * | 9/2002 |
| JP | 2011-027356 | | | 2/2011 |
| JP | 2015-528071 | A | | 9/2015 |

* cited by examiner

HEAT-INSULATION BOX

TECHNICAL FIELD

The technical field relates to a heat-insulation box. In particular, the technical field relates to a structure of a partition part in heat-insulation boxes (e.g., refrigerators) that have multiple chambers.

BACKGROUND

Inside heat-insulation boxes (e.g., refrigerators) having multiple chambers, partition plates that are resin-molded products interiorly including heat-insulation materials, are provided, so as to partition the internal space into multiple chambers each having different environments (e.g., temperature and humidity), according to storage products such as foods.

Such partition plates are provided to improve strength of heat-insulation boxes. Design plates provided at open-part-sides of the partition plates are provided with front design surfaces, and edge sides that are folded vertically to the design surfaces, such that the design plate are formed in the shape of the letter "U."

Moreover, in order to maintain packings provided on doors, and bodies of the boxes in a sealed state, it is required that the design plates are made of magnetic materials that magnets provided inside the packings will attach to. Furthermore, since the design plates have profound effects on improvements of strength of the refrigerators, inexpensive coated steel plates with high strength have been used for the design plates.

However, since design plates are formed of coated steel plates having excellent heat conductance, heat will be caused to flow from high-temperature zones outside the chambers to low-temperature zones inside the chambers. As a result, heat-insulation performance of the heat-insulation boxes will be deteriorated, and also, the design plates will be cooled to a temperature equal to or below a dew point of the outside air (i.e., the atmosphere around sites where the refrigerators are placed), thereby causing dew condensation.

In order to cope with the above-mentioned problem, a means for preventing occurrence of dew condensation is provided in a conventional refrigerator disclosed in JP-A-H4-103984. FIG. 12 is a diagram that shows a structure of an area around a partition plate and a design plate in the disclosed conventional refrigerator. The partition plate 21 includes a heat-insulation material 28, an upper plate 26, a lower plate 27, heat-release pipes 22, a heat-accumulation layer 23, a design plate 25, edge parts 25*a* of the design plate, and heat-insulation material 24.

The upper plate 26 and the lower plate 27 are provided on upper and lower sides, respectively, of a urethane-foam heat-insulation material 28 that has been injected through a backside part of the refrigerator so as to be encapsulated therein, and the heat-release pipes 22 for heat release in freezing cycles are provided somewhere between the front sides of the upper plate 26 and the lower plate 27. The heat-release pipes 22 are brought into contact with the design plate 25 via the heat-accumulation layer 23. A solid pliable heat-insulation material 24 made of a polystyrene foam or the like is provided at the front side of the refrigerator in order to prevent leakage of the urethane-foam heat-insulation material 23. When the urethane-foam heat-insulation material 28 is injected through the rear of the refrigerator, the heat-insulation material 24 is pressed by the design plate 25. Accordingly, the temperature is increased to a temperature equal to or higher than the dew point to prevent occurrence of the dew condensation.

Furthermore, a means for enhancing heat-insulation properties of refrigerators while simultaneously realizing prevention of occurrence of dew condensation, and enhancing strength of a partition plate is provided in a publication of Japanese Patent No. 2945553.

FIG. 13 is a view that shows a structure of an area around the partition plate and a design plate included in the heat-insulation box in the conventional refrigerator disclosed in the publication of Japanese Patent No. 2945553. With regards to a partition plate 31, an upper plate 38 and a lower plate 39 are provided on upper and lower sides, respectively, of a urethane-foam heat-insulation material 33 that has been injected through the rear of the refrigerator. Furthermore, the urethane-foam heat-insulation material 33 and heat-release pipes 32 are placed between the upper plate 38 and the lower plate 39. Additionally, another partition wall 36 for partitioning solid and soft heat-insulation material 34, for securing strength of the partition plate 31 and for preventing leakage of the urethane to the front side of the refrigerator during the injection of the urethane-foam heat-insulation material 28 through the rear of the refrigerator.

The heat-release pipes 32 are brought in contact with the design plate 35. Lateral faces of the design plate 35 do not come into direct contact with the upper plate 38 and the lower plate 39, although the lateral faces of the design plate are in direct contact with the upper and lower plates in JP-A-H4-103984. In Japanese Patent No. 294555, the design plate 35 comes into contact with the upper plate 33 and the lower plate 39 via protruding edge parts 35*b* such that the edge parts 35*b* surrounds the hard heat-insulation material 37, together with other members. Furthermore, leg-like edge sides 35*c* are also in contact with ribs 40 of the partition wall 36, thereby securing sufficient strength of the partition plate 31 and preventing occurrence of dew condensation, and, simultaneously, the hard heat-insulation material 37 is provided to enhance heat-insulation properties of the heat-insulation box.

SUMMARY

However, based on the conventional refrigerator disclosed in JP-A-H4-10398 (depicted in FIG. 12), it is impossible to sufficiently suppress heat penetration into chambers of the refrigerator. The design plate 25 is provided with the edge parts 25*a* that exist in the vicinity of surfaces of the upper plate 26 and the lower plate 27 of the partition plate 21. Accordingly, the temperature of the design plate 25 is elevated to prevent the dew condensation. However, the heat released from the heat-release pipes 22 transmits to the edge parts 25*a* through the design plate 25, which is made of a steel plate having high heat conductance, and penetrates into the chamber through the upper plate 26 and the lower plate 27, which are formed of a highly-heat-conductive resin, along the route referred to by "A" in FIG. 12. This causes deterioration in heat-insulation performance of the heat-insulation box.

Furthermore, the solid pliable heat-insulation material 24, which is placed in the vicinity of the heat-release pipes 22 acting as heat-generation sources, is made of a polystyrene foam having a large heat conductivity ($\lambda$=about 0.040 W/(m·K)), and this heat conductivity is about twice the heat conductivity ($\lambda$=about 0.023 W/(m·K)) of the urethane-foam heat-insulation material 28. This aspect also deteriorates heat-insulation properties of the heat-release pipe 22, the edge parts 25*a* of the design plate, and the upper plate 26 and the lower plate 27 of the partition plate, and thus, causes deterioration in the heat-insulation performance of the heat-insulation box.

Furthermore, even based on the conventional refrigerator disclosed in the publication of Japanese Patent No. 2945553 (depicted in FIG. 13), it is impossible to sufficiently prevent heat penetration into chambers of the refrigerator. Since the design plate 35 is in contact with the upper plate 38 and lower plate 39 via the protruding edges 35*b*, the heat released from the heat-release pipes 32 transmits to the upper plate 38 and the lower plate 39 from the front surface part 35*a* via the protruding edges 35*b*, and thus, penetrates into the chamber along the route shown by "B" in FIG. 13. Also, in the same manner, the design plate 35 is in contact with the ribs 40 of the partition wall via the leg-like edge sides 35*c*, and therefore, the heat released from the neat-release pipes 32 transmits to the ribs 40 of the partition wall, and the partition wall 36, from the front surface part 35*a* via the leg-like edge side 35*c*, and thus, penetrates into the chamber also along the route shown by "C" in FIG. 13. Thus, these technical aspects also cause deterioration in the heat-insulation performance of the refrigerator.

Furthermore, in the same manner as JP-A-H4-103984, the solid pliable heat-insulation material 34, which is placed in the vicinity of the heat-release pipes 32 acting as heat-generation sources, is made of a polystyrene foam having a large heat conductivity, and this heat conductivity is about twice the heat conductivity of the urethane-foam heat-insulation material 33. This technical aspect also deteriorates heat-insulation properties of the heat-release pipes 32, the leg-like edge sides 35*c* of the design plate, the partition wall 36, and the upper plate 33 and the lower plate 39 of the partition plate, and thus, causes deterioration in the heat-insulation performance of the heat-insulation box.

The disclosure solves the above-described problems in the conventional arts. That is, an object of the disclosure is to provide a heat-insulation box that realizes prevention of occurrence of dew condensation in the vicinity of the partition plate, and that retakes it possible to suppress heat penetration into chambers of refrigerators through design plates.

In order to achieve the above object, according to an aspect of the disclosure, provided is a heat-insulation box, including: a heat-insulation-box main body that has a space; a door that seals the space; and a partition plate that partitions the space, wherein the partition plate includes (i) a design plate that is placed at a side of the door, (ii) a first plate part and a second plate part that are each provided at both edges of the design plate, (iii) a heat-insulation material that is located in a region surrounded by the design plate, the first plate part, and the second plate part, and (iv) a heat-insulation member that is placed in at least one of a gap between the design plate and the first plate part, and a gap between the design plate and the second plate part.

According to the disclosure, it becomes possible to realize prevention of occurrence of dew condensation around partition plates and to suppress heat penetration into chambers of refrigerators through design plates. Simultaneously, it becomes possible to prevent leakage of urethane foams to front sides of refrigerators during incorporation of the urethane-foam heat-insulation material. Thus, the disclosure makes it possible to improve heat-insulation performance of refrigerators.

DESCRIPTION OF EMBODIMENTS

Hereinafter, embodiments will be described with reference to the drawings.

First Embodiment

Figure 1:
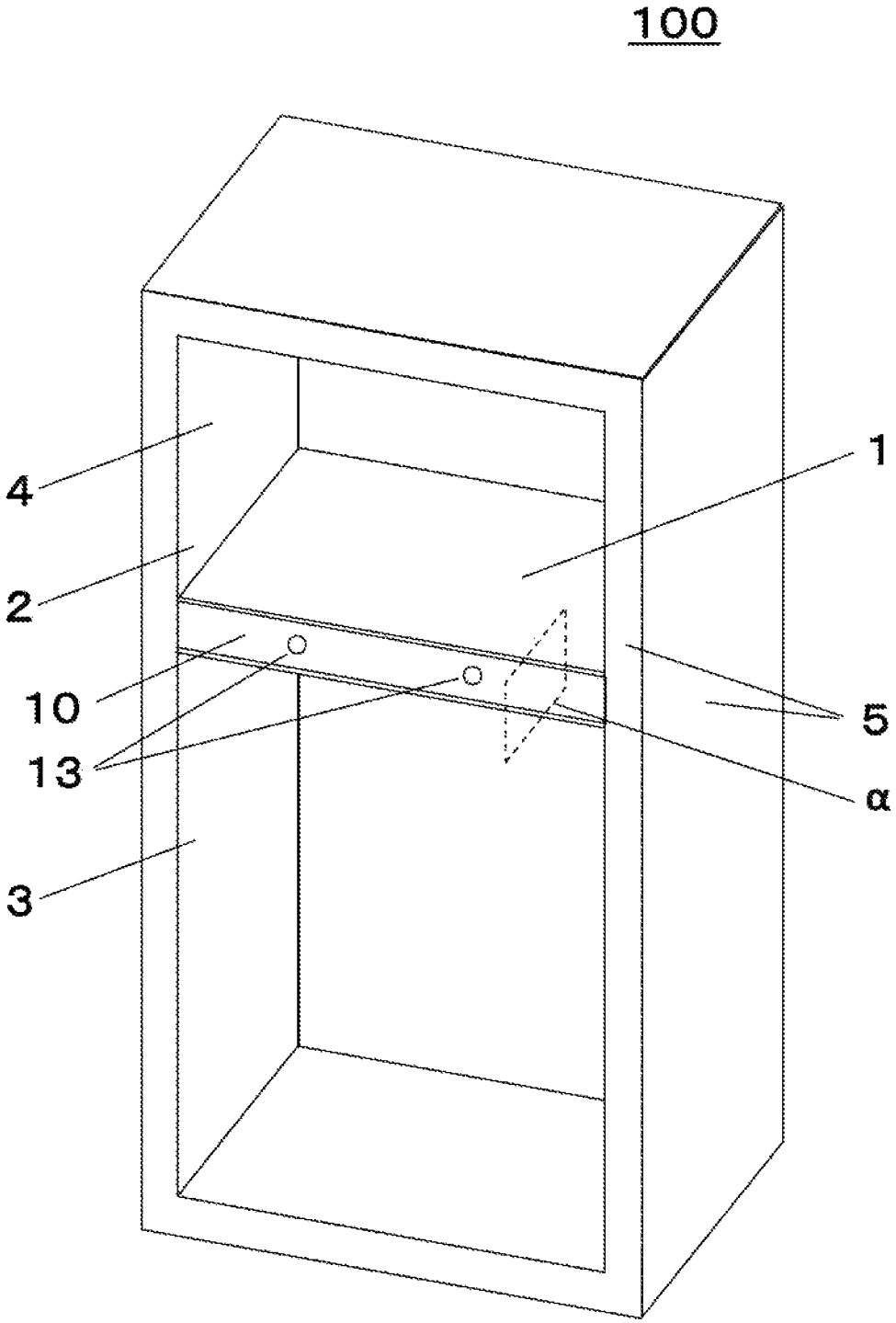
FIG. 1 is a diagram that shows a structure of a heat-insulation box for a refrigerator in first and second embodiments.
Figure 2:
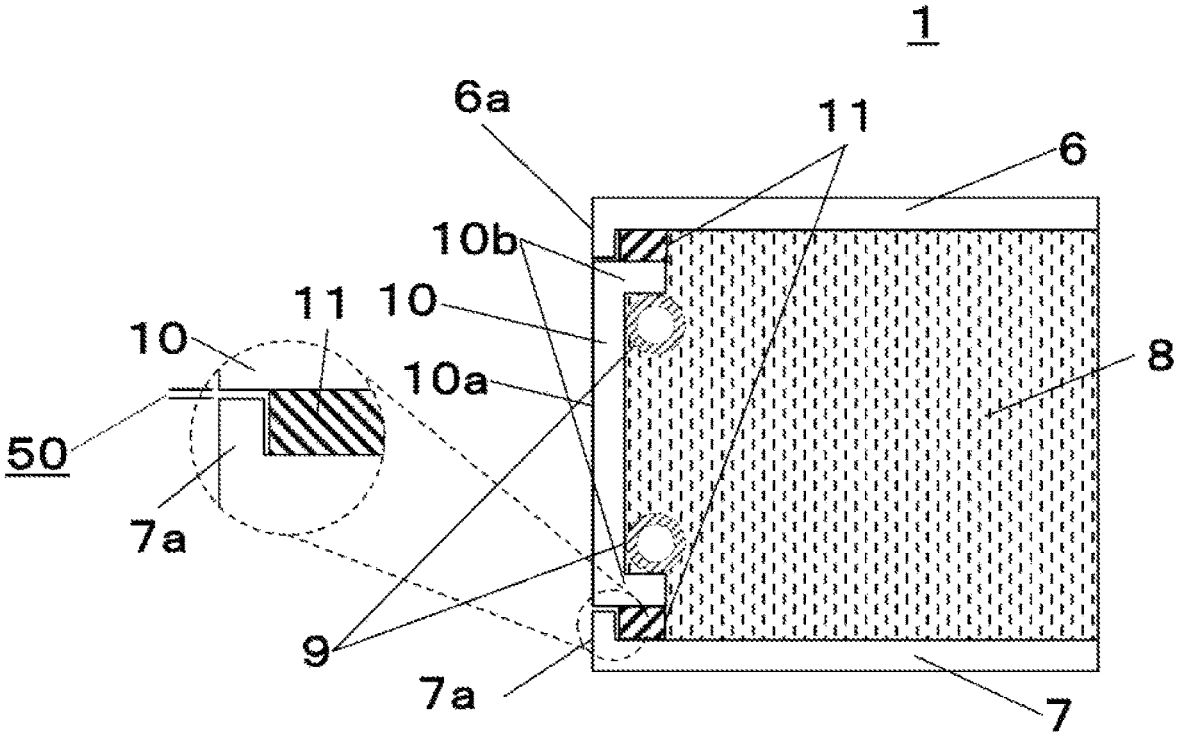
FIG. 2 is a longitudinal sectional view of a part referred to by "α" in FIG. 1 in the first embodiment.
Figure 3:
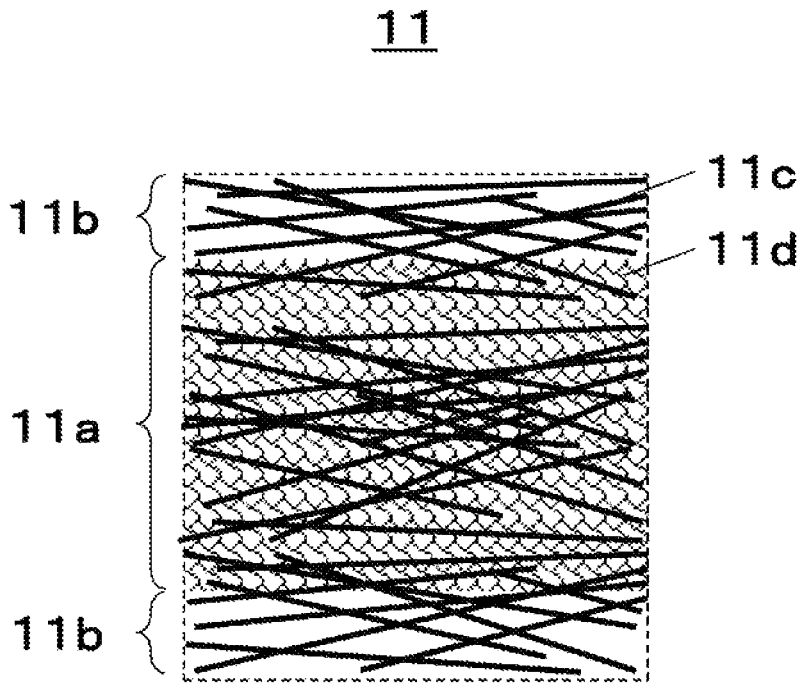
FIG. 3 is a diagram that shows a sectional structure of a flexible composite heat-insulation material.

FIG. 1 is a perspective view that shows a heat-insulation box for a refrigerator in the first embodiment, and FIG. 2 is a longitudinal sectional view of a part referred to by "α" in FIG. 1, and FIG. 3 is an enlarged sectional view of a flexible composite heat-insulation material 11 (heat-insulation member).

The partition plate 1 divides the heat-insulated space into a first storage chamber 2 and a second storage chamber 3. For example, the first storage chamber 2 may be a refrigeration chamber, and the second storage chamber 3 may be a freezing chamber. The partition plate 1 is provided between storage chambers each having different temperature zones.

<Configuration of the Partition Plate 1>

In FIG. 2, the partition plate 1 includes an upper plate 6 (first plate part) and a lower plate 7 (second plate part) on the upper and lower sides, respectively, and a U-shaped design plate 10 provided somewhere between the front sides of the upper plate 6 and the lower plate 7 (i.e., at the front side of the heat-insulation box thereof, or around the door). Heat-release pipes 9 (heat-release parts) for prevention of occurrence of dew condensation are placed on the design plate 10 to come into contact with the design plate 10. In addition, without employing such heat-release pipes 9, any other means or methods for preventing occurrence of dew condensation may be adopted. Additionally, the heat-release pipes 9 are not necessarily provided inside the partition plate 1, and may be provided within any other regions.

The design plate 10 has a front part 10*a* that will appear at the front side of the refrigerator, and sidewall parts 10*b* that are bent by about 90° with respect to the front part 10*a* and that will be located inside the refrigerator.

Flexible composite heat-insulation materials 11 (heat-insulation members) are placed between the upper sidewall part 10*b* of the design plate 10 and the upper plate 6 (first plate part), and between the lower sidewall part 10*b* of the design plate 10 and the lower plate 7 (second plate part), and, is compressed and fixed therebetween. The first plate part 6, the heat-insulation materials 11, and the sidewall parts 10*b* of the design plate 10 are stacked in this manner. The heat-insulation members 11 are easily compressed.

The upper plate 6 (first plate part) and the lower plate 7 (second plate part) are L-shaped. Furthermore, a front part 6*a* and a front part 7*a* that are L-shaped are provided around front sides of the upper plate 6 (first plate part) and the lower plate 7 (second plate part), respectively. In addition, in order to prevent transmission of heat from the design plate 10 to the upper plate 6 (first plate part) and the lower plate 7 (second plate part), the design plate 10 is preferably connected to the upper plate 6 (first plate part) and the lower plate 7 (second plate part) only via the flexible composite heat-insulation materials 11 (heat-insulation members), as shown in dotted circles in FIG. 2. That is, gaps 50 are preferably provided so that the design plate 10 does not come into contact with the front part 6*a* of the upper plate, and the front part 7*a* of the lower plate. Widths of the gaps 50 may be smaller than thickness of each of the heat-insulation materials 11.

In addition, since the front sides of the upper plate 6 (first plate part) and the lower plate 7 (second plate part) are each provided with the L-shaped front part 6*a* and the L-shaped front part 7*a*, respectively, the flexible composite heat-insulation materials 11 (heat-insulation members) are not clearly visible to users at the front side of the refrigerator. As a result, the refrigerator can also maintain its aesthetic properties. Furthermore, a urethane-foam heat-insulation material 8 is filled into a space that are formed by the upper plate 6 (first plate part), the flexible composite heat-insulation materials 11 (heat-insulation members), the heat-release pipes 9 (heat-release parts), the design plate 10, and the lower plate 7 (second plate part).

As a result, the first plate part 6, the heat-insulation materials 11, sidewall parts 10*b* of the design plate 10, and the heat-release pipes 9 are stacked in the above configuration. In other words, these members are provided in alignment with each other. The heat-insulation materials 11 can block paths for heat transmission.

<Configuration of the Flexible Composite Heat-Insulation Materials 11 (Heat-Insulation Members)>

A flexible composite heat-insulation material 11 (heat-insulation member) shown in FIG. 3 is a composite material of an aerogel and a fiber structure. The flexible composite heat-insulation material 11 (heat-insulation member) includes unwoven fabric fibers 11*c* and an aerogel 11*d* as components. The flexible composite heat-insulation material 11 has a layer structure in which a composite layer 11*a* of the aerogel and the fibers is provided in the center, and in which a fiber-only layers 11*b* are provided on the upper and lower sides of the composite layer 11*a*. In the flexible composite heat-insulation material 11, while the aerogel/fiber composite layer 11*a* hardly deforms, the fiber-only layers 11*b* are deformable, and therefore, the flexible composite heat-insulation material 11 has flexibility.

The aerogel/fiber composite layer 11*a* is formed by combining an aerogel with a fiber structure (e.g., unwoven fabrics). Specifically, the aerogel/fiber composite layer 11*a* may be obtained in the following way: the fiber structure is soaked in an aerogel precursor, and an aerogel is produced from the aerogel precursor in the presence of the fiber structure, based on the supercritical drying, or an ordinary-pressure-based drying process.

Aerogels are a solid that has many fine pores with a very high porosity (preferably a porosity of 99% or higher). Particularly, aerogels are a material that has a structure in which bead-like particles of silicon dioxide or the like are joined together, and that has many voids on the scale of nanometers (e.g., 2-50 nm). In this manner, aerogels have nanometer-scale pores and lattice-shaped structures, and therefore, are capable of reducing mean free paths of gaseous molecules. Accordingly, heat conductance through gaseous molecules therein is very small even at ordinary pressure, and their heat conductivities are very small.

For the aerogel, for example, inorganic aerogels including oxides of metals such as silicon, aluminum, iron, copper, zirconium, hafnium, magnesium, and yttrium are preferably used, and silica aerogels including silicon dioxide are more preferably used.

The fiber structure reinforces the aerogel, and simultaneously serves as a reinforcing material or support that supports the aerogel. In order to obtain a flexible composite heat-insulation material, flexible woven fabrics, knitted fabrics, unwoven fabrics, etc. may be used for the fiber structure. As examples of materials for the fiber structure, organic fibers such as polyester fibers, and also, inorganic fibers such as glass fibers can be used.

Heat-insulation materials obtained in this way have a heat conductivity ($\lambda$=about 0.020 W/(m·K)) that is equal to or less than that of a urethane-foam heat-insulation material, and thus, have very high heat-insulation properties.

The fiber-only layers 11*b* include the above-described fiber structure, which does not include any aerogels. The fiber-only layers 11*b* preferably consist essentially of fiber materials. The fiber-only layers 11*b* are provided as elastic layers for the purpose of generation of elasticity in the flexible composite heat-insulation materials 11 (heat-insulation members) when the flexible composite heat-insulation materials 11 are compressed, and also for the purpose of alleviation of variations in the gap between the upper plate 6 (first plate part) and the design plate 10, and the gap between the lower plate 7 (second plate part) and the design plate 10 due to warpage or corrugation of the upper plate 6 (first plate part) and the lower plate 7 (second plate part).

In addition, the fiber-only layers 11*b* provided at the both sides each come into contact with the upper plate 6 and the design plate 10. Each of the fiber-only layers 11*b* is compressed by the adjacent plates. In this case, the fiber-only layers 11*b* are mainly compressed. However, heat conductivities of the heat-insulation materials 11 will almost not be changed, and the heat-insulation properties can be maintained, even when they are compressed, since contributions of the aerogel/fiber composite layers 11*a* to the heat conductivities are dominant.

The layer direction of the fiber-only layers 11*b* and the aerogel/fiber composite layer 11*a* is the same as the compressed direction.

Production Method

With regards to the heat-insulation box configured in the above manner, a production method and effects thereof will be described below.

<Production of a Flexible Composite Heat-Insulation Material 11 (Heat-Insulation Member)>

The method for producing a flexible composite heat-insulation material 11 (heat-insulation member) includes: the following eight steps: (i) a sol-preparation step; (ii) an impregnation step; (iii) a lamination step; (iv) a gelatinization step; (v) an aging step; (vi) an aqueous acid solution-soaking step; (vii) a hydrophobization step; and (viii) a drying step. Each of the steps will be described below.

(i) Sol-Preparation Step

In the sol-preparation step, water glass or a high-molar-ratio silicate aqueous solution may be used as a starting material. In the case in which water glass is used as a starting material, sodium is removed from the water glass based on an ion-exchange resin or electrodialysis, and is acidified to thereby convert it into a sol. Then, a base serving as a catalyst is added to the sol, and is polymerized to produce a hydrogel. On the other hand, in the case in which a high-molar-ratio silicate aqueous solution is used as a starting material, an acid serving as a catalyst is added to the high-molar-ratio silicate aqueous solution, and thus, is polymerized to produce a hydrogel.

(ii) Impregnation Step 6.5 to 10 times the amount of the sol solution prepared in step (i) in terms of weight is poured to unwoven fabrics formed of PET, glass wool rock wool, or the like and that has a thickness of 0.2 mm to 1.0 mm, and thus, the unwoven fabrics are impregnated with the sol solution. For the impregnation method, the sol solution may be spread over a film or the like at a certain thickness in advance, and the unwoven fabrics may be overlaid thereon to cause the sol solution to penetrate into the unwoven fabrics.

(iii) Lamination Step

Figure 4A:
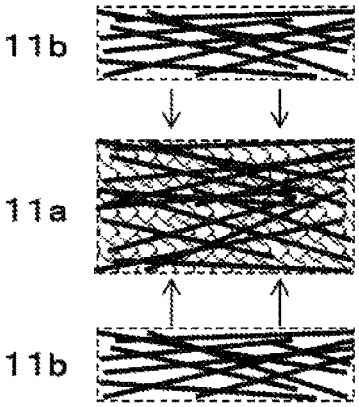
FIG. 4A is a diagram that shows a structure of a flexible composite heat-insulation material prior to a lamination step.

The layer structure will be described with reference to FIGS. 4A to 4C. Based on Steps (i) and (ii), the aerogel/fiber composite layer 11*a* in FIG. 4A is prepared. In the lamination step, unwoven fabrics are layered on the aerogel/fiber composite layer 11*a* to produce fiber-only layers 11*b*, and thus, these layers are combined with the aerogel/fiber composite layer 11*a*.

Figure 4B:
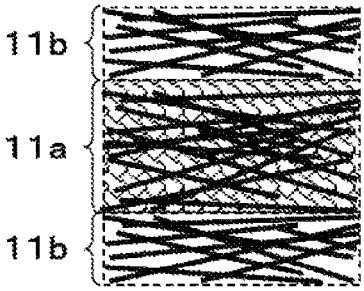
FIG. 4B is a diagram that shows a structure of a flexible composite heat-insulation material produced based on lamination.

At first, as shown in FIGS. 4A and 4B, the aerogel/fiber composite layer 11*a* that has been produced through the impregnation step (ii) is sandwiched between upper and lower unwoven fabrics. In this case, a part of the sol ingredient included in the aerogel/fiber composite layer 11*a* is caused to penetrate into (permeate) the unwoven fabrics that serve as the fiber-only layers 11*b*, due to the osmotic pressure.

(iv) Gelatinization Step

After step (iii), the sol is converted into a gel. A temperature for converting the sol into a gel (gelatinization temperature) is preferably from 20° C. to 90° C. If the gelatinization temperature is less than 20° C., a required amount of heat may not be conveyed to silicate monomers that serve as active species for the reaction. Therefore, in that case, growth of silica particles may not be promoted. Consequently, it may take a while until gelatinization of the sol sufficiently progresses. Furthermore, strength of the produced gel (aerogel) may be lower, the gel may significantly shrink during the drying step, and thus, an aerogel with desired strength may not be obtained.

On the other hand, if the gelatinization temperature exceeds 90° C., growth of silica particles may excessively be promoted. As a result, volatilization of water may rapidly be caused therein, and thus, a phenomenon in which water and the hydrogel are separated from each other may be observed. Accordingly, a volume of the resulting hydrogel may be reduced, and thus, any silica aerogels may not be obtained.

In addition, although the gelatinization time varies with the gelatinization temperature, and the aging time described below, a sum of the gelatinization time and the aging time is preferably from 0.1 hour to 12 hours. Furthermore, the gelatinization time is preferably from 0.1 hour to 1 hour in order to achieve an ideal balance between the performance (heat conductivities) and the production unit time.

If the gelatinization time is longer than 12 hours, reinforcement of the silica network would sufficiently proceed. However, if it takes a longer time for the aging step, not only the productivity would be impaired, but also shrinkage of the gel would be caused. Consequently, a bulk density of the gel may be increased, and therefore, the resulting flexible composite heat-insulation materials 11 (heat-insulation members) would have elevated heat conductivities, and this is not preferable.

By carrying out the gelatinization step in the above manner, strength and rigidity of walls of the hydrogel will be improved, and thus, a hydrogel that hardly shrinks during the drying step can be obtained. Furthermore, when the sol is solidified in form of a gel, the aerogel that has permeated the unwoven fabrics is solidified. As a result, all of the layers are combined so as to form a layer structure that includes the aerogel/fiber composite layer 11*a* and the fiber-only layers 11*b*, as shown in FIG. 4C.

(v) Aging Step

In the aging step, a skeleton of the gelatinized silica is reinforced to produce a hydrogel with a reinforced skeleton. The aging temperature is preferably from 50° C. to 100° C. If the aging temperature is less than 50° C., a dehydration/polycondensation reaction may relatively be slowed, and therefore, it may become difficult to sufficiently reinforce the silica network within a production unit time targeted in view of sufficient productivity.

If the aging temperature is higher than 100° C., water contained in the gel may excessively be evaporated, and therefore, shrinkage and drying of the gel may occur. As a result, the resulting gel may have an elevated heat conductivity.

The aging time is preferably from 0.1 hour to 12 hours, and is more preferably 0.1 hour to 1 hour in order to achieve an ideal balance between the performance (heat conductivities) and the production unit time.

If the aging time is longer than 12 hours, reinforcement of the silica network would sufficiently progress. However, if it takes a longer time for the aging step, not only the productivity may be impaired, but also shrinkage of the gel would be caused. Consequently, the bulk density may be increased, and therefore, there may be a problem in which the neat conductivity is elevated.

By carrying out the aging step within a range from 0.1 hour to 6 hours, the network of silica particles can sufficiently be reinforced while sufficient productivity is retained.

(vi) Aqueous Acid Solution-Soaking Step

The composite of the gel and the unwoven fabrics is soaked in aqueous hydrochloric acid (6 to 12 N), and then allowed to stand for 45 minutes or more at ordinary temperature (23° C.) to cause the composite to incorporate hydrochloric acid.

(vii) Hydrophobization Step

The composite of the gel and the unwoven fabrics is soaked, for example, in a mixture solution of octamethyltrisiloxane serving as a silylating agent, and 2-propanol (IPA; an alcohol), and reacted in a thermostatic chamber at 55° C. for 2 hours. When formation of polymethylsiloxane bonds starts, aqueous hydrochloric acid is discharged from the gel sheet, and the liquid phase is separated into two liquids (siloxane in the upper layer, and aqueous hydrochloric acid in the lower layer).

(viii) Drying Step

The composite of the gel and the unwoven fabrics is transferred to a thermostatic chamber at 150° C., and is dried for two hours (in case of ordinary-pressure drying).

Based on the above-described steps, the flexible composite heat-insulation materials 11 (heat-insulation members) are produced.

Production of the Partition Plate 1

A method for producing the partition plate 1 will be described with reference to FIGS. 1, 2, 5 and 6.

Figure 5:
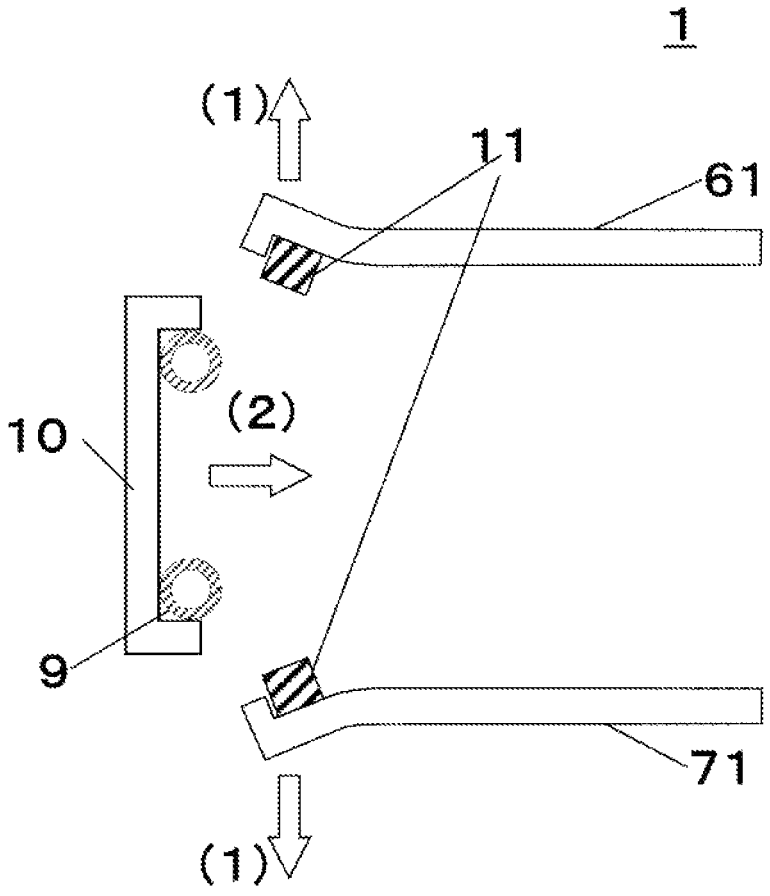
FIG. 5 is a diagram that shows a step in which a design plate is incorporated into a space between upper and lower plates of a partition plate included in heat-insulation boxes for refrigerators in first, second and fourth embodiments.

In FIG. 1, the outer box 5 and the inner box 4 are engaged with each other. Then, with regards to the partition plate 1 in FIG. 1, a design plate 10 on which heat-release pipes 9 (heat-release parts) are fixed by use of a tape or the like (not shown in the figure) is provided, and flexible composite heat-insulation materials 11 (heat-insulation members) are placed on a lower surface of the upper plate 6 (first plate part) and on an upper surface of the lower plate 7 (second plate part) in the partition plate 1, by use of tapes (not shown in the figure), as shown in FIG. 5.

Subsequently, the upper plate 6 (first plate part) and the lower plate 7 (second plate part) of the partition plate 1 that has temporally been fixed onto the heat-insulation box are slightly stretched to the upward and downward directions, respectively, as shown by arrows (1) in FIG. 5. Then, as shown by arrow (2) in FIG. 5, the design plate 10 is transferred to a space between the flexible composite heat-insulation materials 11 (heat-insulation materials) each placed on the upper plate 6 (first plate part) and the lower plate 7 (second plate part), and these materials are combined.

Figure 6:
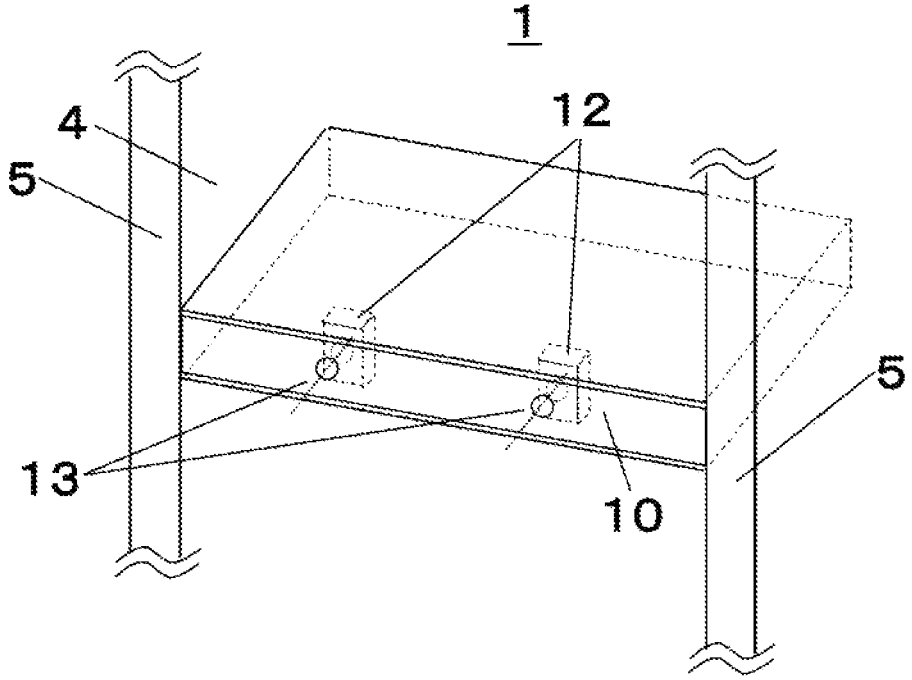
FIG. 6 is a diagram that shows a screw-fastening mechanism for a partition plate included in heat-insulation boxes for refrigerators in first, second, third and fourth embodiments.

With regard to positional fixation of the assembled design plate 10, as shown in the perspective view of FIG. 6, by use of screws (not shown in the figure), the design plate 10 is fixed onto attachment ribs 12 of the partition plate 1 placed somewhere between the upper plate 6 (first plate part) (not shown in the figure) and the lower plate 7 (second plate part) (not shown in the figure), via screw holes 13 that are provided in the design plate 10 so as to correspond to positions of the attachment ribs 12.

Finally, a urethane-foam heat-insulation material 8 is poured into a space between the outer box 5 and the inner box 4, and a space between the upper plate 6 (first plate part) and the lower plate 7 (second plate part) in FIG. 2, from the rear of the heat-insulation box 100 in FIG. 1, and then, is cured to produce the partition plate 1 and the heat-insulation box 100.

In that case, as shown in FIG. 2, the flexible composite heat-insulation materials 11 (heat-insulation members) are compressed and thus immobilized between the upper plate 6 (first plate part) and the lower plate 7 (second plate part) by the design plate 10, and therefore, the urethane-foam heat-insulation material 8 never leaks from the front side of the heat-insulation box when it is injected thereto.

As a result, the heat-insulation material 8 is surrounded by the heat-insulation members 11, the design plate 10, the first plate part 6, and the second plate part 7.

<Effects Brought about by the First Embodiment>

As shown in FIG. 2, heat released from the heat-release pipes 9 transmits to the sidewall parts 10*b* through the front part 10*a* of the design plate 10, and thus, will bring about effects to prevent incidence of dew condensation on the surface of the design plate 10. Meanwhile, since the flexible composite heat-insulation materials 11 (heat-insulation members), which have high heat-insulation properties, are placed adjacently to the sidewall parts 10*b*, the heat does not transmit to the upper plate 6 (first plate part) and the lower plate 7 (second plate part) of the partition plate 1, to prevent heat penetration into the chamber.

In particular, even when the flexible composite heat-insulation materials 11 (heat-insulation members) receive compression force (pressing force), and thus, shrink, their heat conductivities will not almost change.

Figure 7:
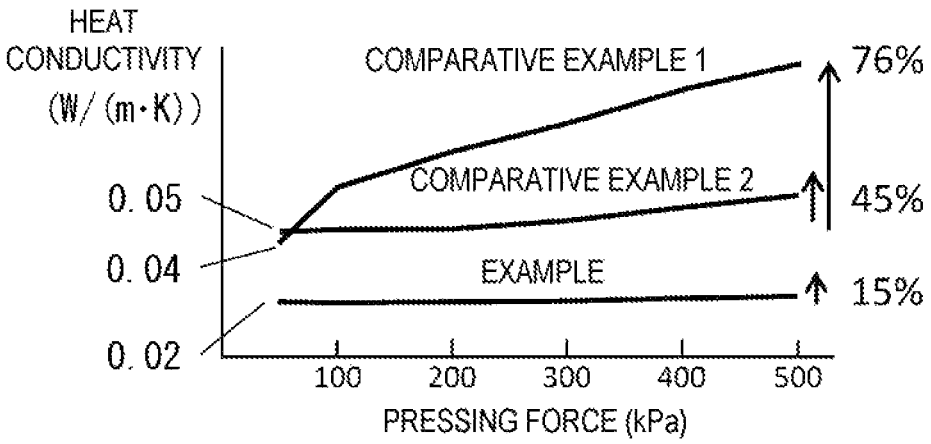
FIG. 7 is a graph that shows changes in heat conductivities obtained in cases in which a flexible composite heat-insulation material, and other heat-insulation materials were pressed.

FIG. 7 shows a relationship between the pressing force and heat conductivities for the flexible composite heat-insulation materials 11 (heat-insulation members). The flexible composite heat-insulation materials 11 (heat-insulation members) in the first embodiment (EXAMPLE), foamed-resin-made heat-insulation materials having the same thickness (COMPARATIVE EXAMPLE 1), and resin-made heat-insulation materials having the same thickness (COMPARATIVE EXAMPLE 2) were evaluated. The data shown in FIG. 7 were obtained by measuring heat conductivities of the samples in a state in which various pressing forces were applied to the samples.

The foamed-resin-made heat-insulation materials (COMPARATIVE EXAMPLE 1) exhibited a heat conductivity (λ) of 0.04 W/(m·k) at the initial phase. However, they showed a 76% increase in heat conductivity when a pressing force of 500 kPa was applied thereto.

The resin-made heat-insulation materials (COMPARATIVE EXAMPLE 2) exhibited a heat conductivity (λ) of 0.05 W/(m·K) at the initial phase. However, they showed a 45% increase in heat conductivity when a pressing force of 500 kPa was applied thereto.

On the other hand, the flexible composite heat-insulation materials 11 (EXAMPLE) showed only a 15% increase in heat conductivity when they were pressed at a pressing force of 500 kPa.

Thus, the flexible composite heat-insulation materials 11 (heat-insulation members) are suitable for compression-based fixation in spaces that are formed by the design plate 10, the upper plate 6 (first plate part), and the lower plate 7 (second plate part). That is, even when the flexible composite heat-insulation materials 11 (heat-insulation members) are compressed, the heat-insulation effects will not be deteriorated. The flexible composite heat-insulation materials 11 (heat-insulation members) are preferable as heat-insulation materials.

Figure 4C:
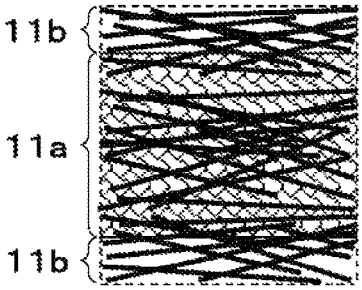
FIG. 4C is a diagram that shows a structure of a gelatinized flexible composite heat-insulation material.

Furthermore, beside the capabilities of the flexible composite heat-insulation materials 11 (heat-insulation members) of being compressed and thus being fixed in spaces that are formed by the design plate 10, the upper plate 6 (first plate part), and the lower plate 7 (second plate part), the flexible composite heat-insulation materials 11 (heat-insulation members) are provided with the fiber-only layers 11*b*, which each have elasticity coping with variations in the spaces that are formed by the upper plate 6 (first plate part), the lower plate 7 (second plate part), and the design plate 10, as shown FIG. 4C.

Figure 12:
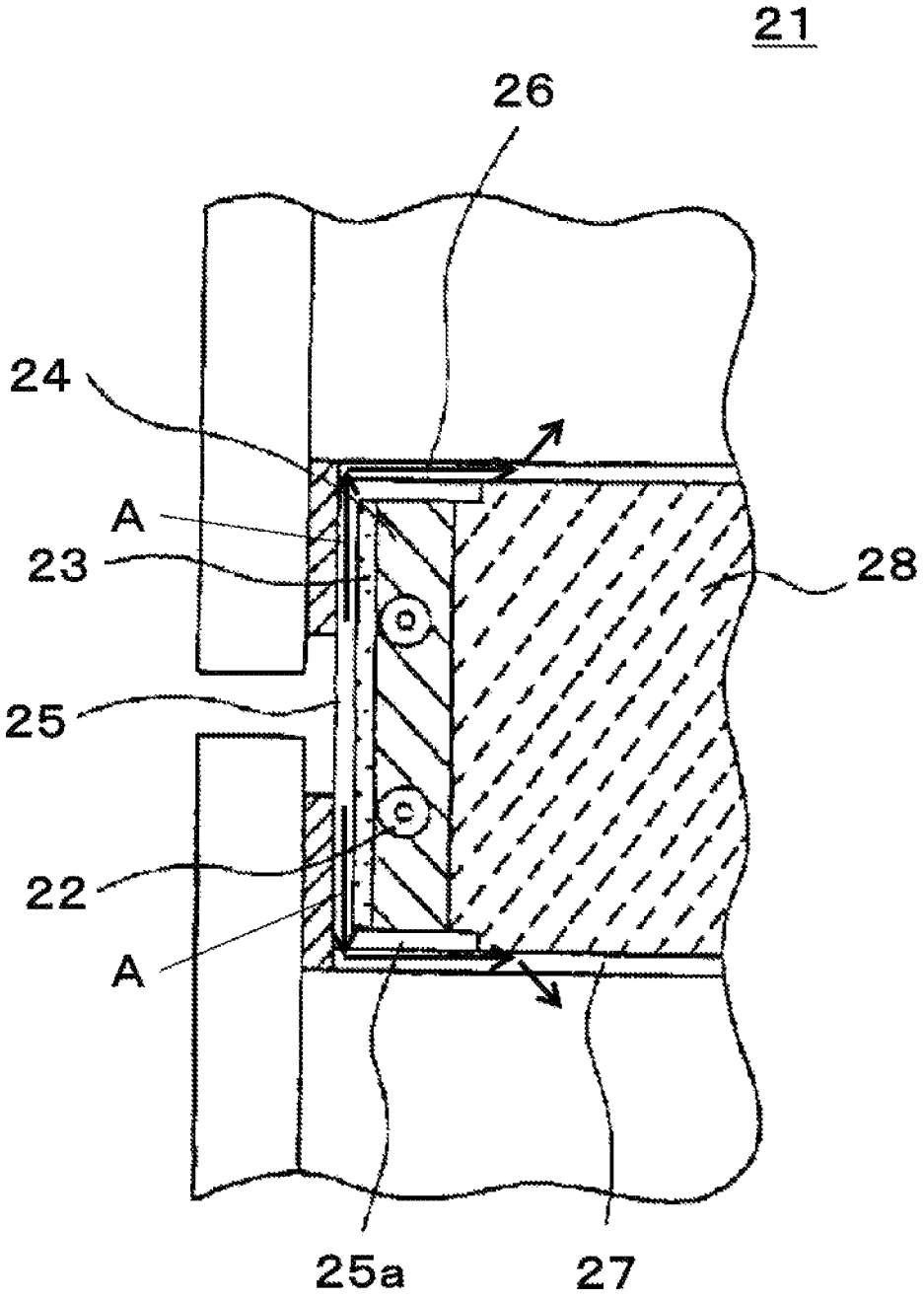
FIG. 12 PRIOR ART
FIG. 12 is a cross-section view that shows a structure of the partition plate included in the heat-insulation box in the conventional refrigerator disclosed in JP-A-H4-103984.
Figure 13:
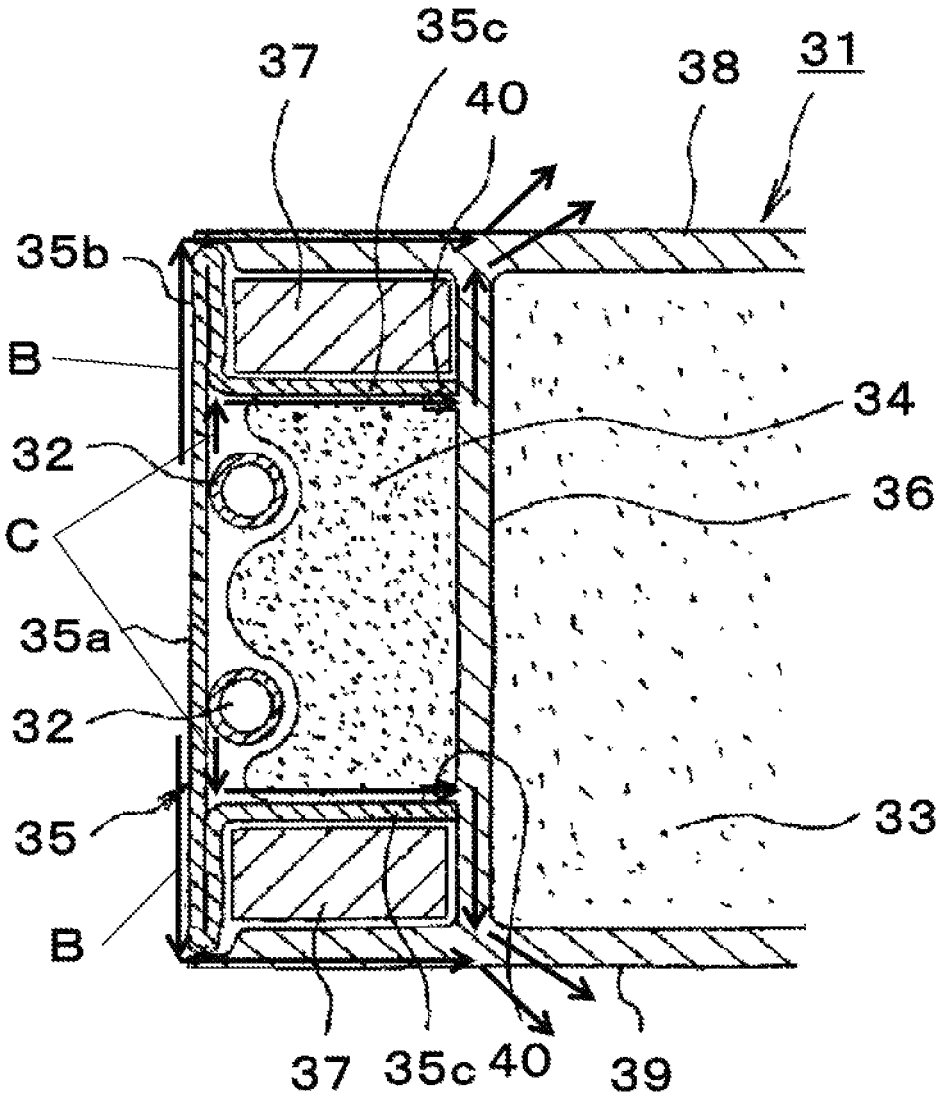
FIG. 13 PRIOR ART
FIG. 13 is a cross-section view that shows a structure of the partition plate included in the heat-insulation box in the conventional refrigerator disclosed in the publication of Japanese Patent No. 2945553.

Accordingly, it is unnecessary to utilize the polystyrene-foam-made heat-insulation material 34 (FIG. 13), which has poor heat-insulation properties and which had been used for preventing leakage of the urethane-foam heat-insulation material 8 in conventional refrigerators, the heat-insulation material 24 (FIG. 12), and the partition wall 36 (FIG. 13).

Furthermore, according to the partition plate 1 in the first embodiment, a urethane-foam heat-insulation material 8 having high heat-insulation properties can be incorporated into areas in the vicinity of the heat-release pipes 19. Accordingly, it becomes possible to prevent heat penetration into the chamber from the heat-release pipes 19 through the upper plate 6 (first plate part) and the lower plate 7 (second plate part).

Furthermore, as shown in FIG. 2, the front sides of the upper plate 6 (first plate part) and the lower plate 7 (second plate part) of the partition plate 1 are L-shaped, and therefore, the flexible composite heat-insulation materials 11 (heat-insulation members) will not be recognized by users from the front side of the refrigerator. As a result, the refrigerator can maintain its aesthetic properties.

In addition, although the flexible composite heat-insulation materials 11 (heat-insulation members) are provided in the two sites, a flexible composite heat-insulation material 11 may be provided at at least one of the sites.

Second Embodiment

Figure 8:
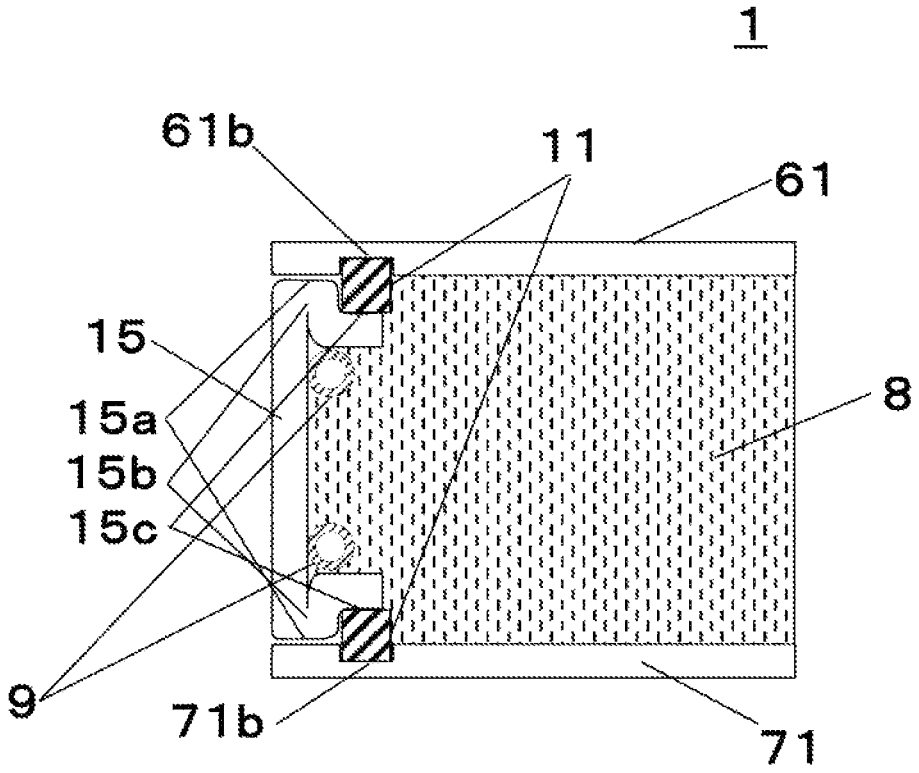
FIG. 8 is a longitudinal sectional view of a part referred to by "α" in FIG. 1 in the second embodiment.

FIG. 8 is a longitudinal sectional view of a part referred to by "α" in FIG. 1. FIG. 8 corresponds to FIG. 2 showing the first embodiment.

A difference between the first embodiment and the second embodiment is that shapes of a design plate 1, an upper plate 61 (first plate part), and a lower plate 71 in FIG. 8 differ from those in the first embodiment. Matters not mentioned in this embodiment are the same as those described for the first embodiment.

<Configurations of the Design Plate 15, the Upper Plate 61 (First Plate Part), and the Lower Plate 71 (Second Plate Part)>

In FIG. 8, double-folded parts 15*b* are formed at edge parts of the design plate 15, based on a folding processing such as roll forming. Then, the double-folded parts 15*b* are again folded to form planes parallel to the upper plate 61 (first plate part) and the lower plate 71 (second plate part), and thus, folded flat parts 15*c* are provided therein.

That is, both of edges of the design plate 15 each have a double structure, and interior projections. The heat-insulation material is retained by the projections.

Steps (recessed parts) 61*b* and 71*b* are provided in the upper plate 61 (first plate part) and the lower plate 71 (second plate part), respectively, parallel to the design plate 10, such that the flexible composite heat-insulation materials 11 (heat-insulation materials) fit the respective steps (recessed parts) 61*b* and 71*b*.

In addition, the heat-insulation members may be fixed by not steps (recessed parts) but by two projection parts.

Additionally, in order to prevent heat transmission from the design plate 15 to the upper plate 61 (first plate part) and the lower plate 71 (second plate part), the design plate 15, the upper plate 61 (first plate part), and the lower plate 71 (second plate part) are preferably connected only via the flexible composite heat-insulation materials 11 (heat-insulation members), and gaps are preferably provided therebetween so that the edge parts 15*a* of the design plate 15, the upper plate 61 (first plate part), and the lower plate 71 (second plate part) do not come into direct contact with each other.

<Effects Brought about by the Second Embodiment>

Besides the effects mentioned in the first embodiment (e.g., dew-condensation-prevention effects, and effects to prevent heat penetration into chambers), it becomes possible to improve accuracy of positioning of the flexible composite heat-insulation materials 11 (heat-insulation members) in assembling the partition plate 1, since steps 61*b* and 71*b* are provided in the upper plate 61 (first plate part) and the lower plate 71 (second plate part), respectively, and the design plate 15 has the folded parts.

Additionally, since the design plate 15 has the folded parts as shown in FIG. 8, the flexible composite heat-insulation materials 11 (heat-insulation members) will not visible to users from the front side of the refrigerator. As a result, the refrigerator can maintain its aesthetic properties.

Third Embodiment

Figure 9:
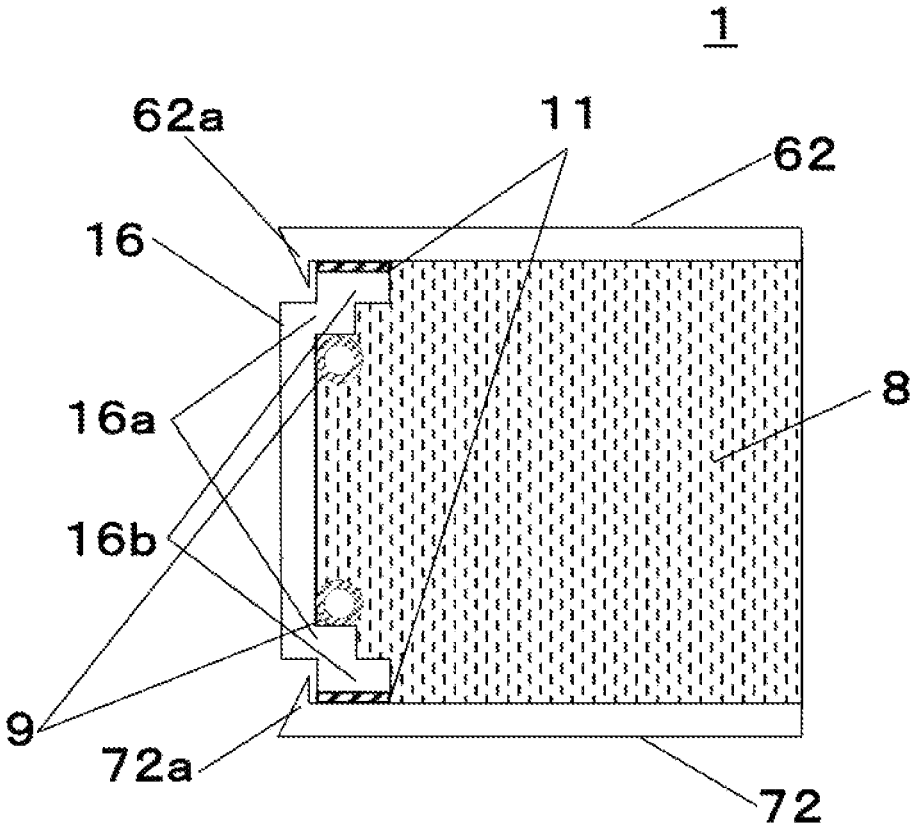
FIG. 9 is a longitudinal sectional view of a part referred to by "α" in FIG. 1 in the third embodiment.

FIG. 9 is a longitudinal sectional view of a part referred to by "α" in FIG. 1. FIG. 9 corresponds to FIG. 2 snowing the first embodiment.

A difference between the first embodiment and the third embodiment is that shapes of a design plate 16, an upper plate 62 (first plate part), and a lower plate 72 (second plate part), and a method for producing a partition plate 1 (a method for incorporating the design plate 16 into a space between the upper plate 62 (first plate part) and the lower plate 72 (second plate part)) in the third embodiment differ from those in the first embodiment. Matters not mentioned in this embodiment are the same as those described for the first embodiment.

<Configuration of the Design Plate 16, the Upper Plate 62 (First Plate Part), and the Lower Plate 72 (Second Plate Part)>

In FIG. 9, the design plate 16 has first step parts 16*a* and second step parts 16*b* that are formed based on two-step press working or the like. The front sides of the upper plate 62 (first plate part) and the lower plate 72 (second plate part) are provided with hook return parts 62*a* and 72*a*, respectively.

In addition, in order to prevent heat transmission from the design plate 16 to the upper plate 62 (first plate part) and the lower plate 72 (second plate part), the design plate 16, the upper plate 62 (first plate part), and the lower plate 72 (second plate parts are preferably connected only via flexible composite heat-insulation materials 11 (heat-insulation members), and spaces are preferably provided therebetween such that the first step 16*a*, a hook return part 62*a* of the upper plate, and a hook return part 72*a* of the lower plate in the design plate 16 do not come into direct contact with each other.

<Production of the Partition Plate 1 (Method for Incorporating the Design Plate 16 into a Space Between the Upper Plate 62 (First Plate Part) and the Lower Plate 72 (Second Plate Part))>

Figure 10A:
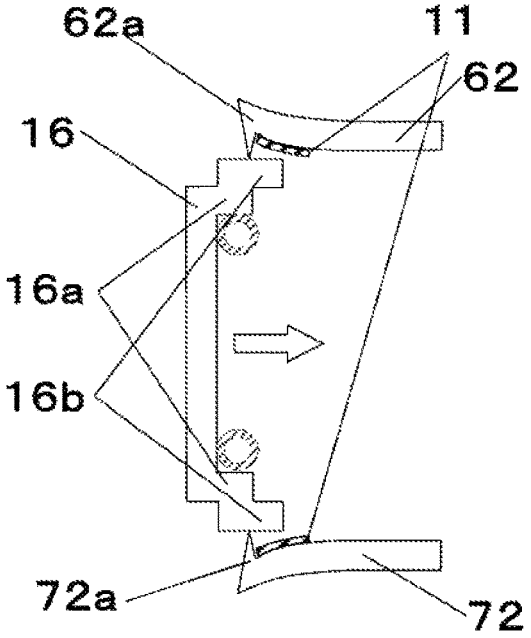
FIG. 10A is a diagram that shows a halfway step in which a design plate is inserted into a partition plate in the third embodiment.

FIG. 10A is a diagram that shows steps for incorporating the design plate 16 into a space between the upper plate 62 (first plate part) and the lower plate 72 (second plate part) of the partition plate 1. When the design plate 16 is pushed into a space between the upper plate 62 (first plate part) and the lower plate 72 (second plate part) to the direction shown by the arrow, the upper and lower surfaces of the second steps 16*b* in the design plate 16 push taper parts of hook return parts 62*a* and 72*a* of the upper plate 62 (first plate part) and the lower plate 72 (second plate part), respectively, and thus, the open part that is formed by the upper plate 62 (first plate part) and the lower plate 72 (second plate part) will be stretched. Accordingly, the design plate 16 can be placed in an area between the flexible composite heat-insulation materials 11 (heat-insulation members) that are placed on the upper plate 62 (first plate part) and the lower plate 72 (second plate part), respectively.

Figure 10B:
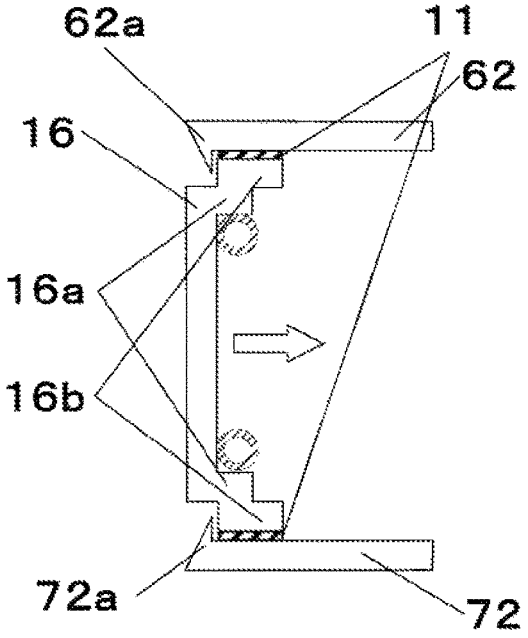
FIG. 10B is a diagram that shows a state in which the design plate has been inserted into the partition plate in the third embodiment.

FIG. 10B is a diagram that shows a state in which the design plate 16 has been inserted into a space between the upper plate 62 (first plate part) and the lower plate 72 (second plate part) of the partition plate 1. When the second steps 16*b* (stair-like shape) are pushed into a space between the upper plate 62 (first plate part) and the lower plate 72 (second plate part), and is located inward beyond the respective hook return parts 62*a* and 72*a*, no external force is applied to the hook return parts 62*a* and 72*a*. In this case, due to springback effects, the flexible composite heat-insulation materials 11 (heat-insulation members), and the second steps 16*b* of the design plate 16 come into contact with each other, and the flexible composite heat-insulation materials 11 (heat-insulation members) are compressed and thus fixed therein. For production of the partition plate 1, matters other than those described above are the same as those described in the first and second embodiments.

<Effects Brought about by the Third Embodiment>

According to the third embodiment shown in FIG. 9, besides the effects mentioned in the first embodiment (e.g., dew-condensation-prevention effects, and effects to suppress heat penetration to chambers), steps for producing the partition plate 1, in particular, incorporation of the design plate 16 into a space between the upper plate 62 (first plate part) and the lower plate 72 (second plate part), can be simplified, since hook return parts 62*a* and 72*a* are provided at the front sides of the upper plate 62 (first plate part) and the lower plate 72 (second plate part). That is, in the first or second embodiment, although the open part formed by the upper plate and the lower plate needs to be stretched for insertion of the design plate, it is only required in this embodiment that the design plate 16 is pushed into a space between the upper plate 62 (first plate part) and the lower plate 72 (second plate part) as described above.

Furthermore, as shown in FIG. 9, the hook return parts 62*a* and 72*a* are provided at the front sides of the upper plate 62 (first plate part) and the lower plate 72 (second plate part), and therefore, the flexible composite heat-insulation materials 11 (heat-insulation members) will not be visible to users from the front side of the refrigerator. As a result, the refrigerator can maintain its aesthetic properties.

Fourth Embodiment

Figure 11:
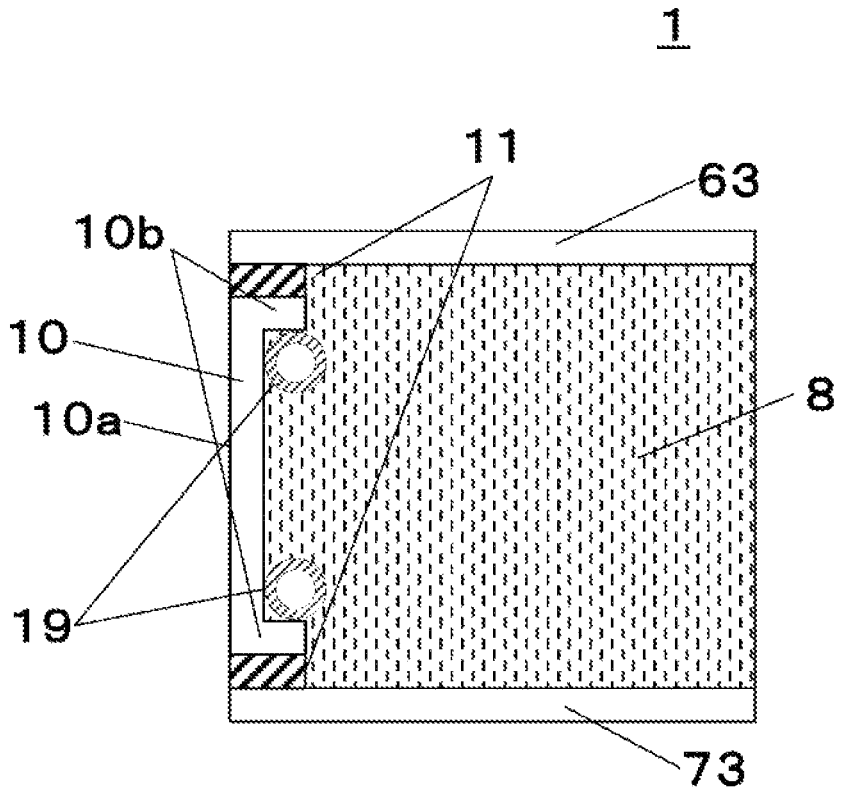
FIG. 11 is a longitudinal sectional view of a part referred to by "α" in FIG. 1 in the fourth embodiment.

FIG. 11 is a longitudinal sectional view of a part referred to by "α" in FIG. 1. FIG. 9 corresponds to FIG. 2 showing the first embodiment.

A difference between the first embodiment and the fourth embodiment is that shapes of an upper plate 63 (first plate part) and a lower plate 73 (second plate part) in FIG. 11 differ from those in the first embodiment. Front surfaces of sidewall parts 10*b* each have a flat shape (i.e. the front sides sidewall parts that are inserted between the upper plate 63 (first plate part) and the lower plate 73 (second plate part) are flat). Matters not mentioned in this embodiment are the same as those described for the first embodiment.

<Effects Brought about by the Fourth Embodiment>

Besides the effects mentioned in the first embodiment (e.g., dew-condensation-prevention effects, and effects to suppress heat penetration to chambers), it becomes possible to produce the upper plate 63 (first plate part) and the lower plate 73 (second plate part) in a simple way. For example, the upper plate 63 (first plate part) and the lower plate 73 (second plate part) can be configured by using a flat plate as a base material.

Even based on such a simple production method, since the flexible composite heat-insulation materials 11 (heat-insulation members) are rigidly compressed and thus fixed in spaces that are formed by the upper plate 63 (first plate part), the lower plate 73 (second plate part), and the design plate 10, the internal urethane never leaks out.

Although it may be difficult to secure aesthetic properties, refrigerators according to this embodiment can be employed as refrigerators for which it is unnecessary to place an emphasis on aesthetic properties (e.g., on-premise, consumer-use or professional-use refrigerators).

OVERALL

Additionally, the above-described embodiments can be combined.

Furthermore, although both of the edges of the design plates 10 have the same shape in the above embodiments, either of the edges may be formed in one of the shapes described in the above embodiments. Alternatively, the edges may have different shapes in some embodiments.

A heat-insulation box according to the disclosure can be utilized for the purpose of improving heat-insulation performance of various cooling/heating apparatuses (consumer-use and professional-use refrigerators, wine cellars, etc.) that have a mechanism for partitioning a chamber space into multiple chamber having different temperature zones.

What is claimed is:

1. A heat-insulation box, comprising:

a heat-insulation-box main body that has a space;

a door that seals the space; and a partition plate that partitions the space, wherein the partition plate comprises (i) a design plate that is placed at a side of the door, (ii) a first plate part and a second plate part that are each provided at edges of the design plate, (iii) a heat-insulation material that is located in a region surrounded by the design plate, the first plate part, and the second plate part, and (iv) a first heat-insulation member that is placed only within a first gap defined by a first bent portion bent at a first end portion of the design plate and the first plate part, and does not protrude beyond an end of the first bent portion, and a second heat-insulating member that is placed only within a second gap defined by a second bent portion bent at a second end portion of the design plate and the second plate part, and does not protrude beyond an end of the second bent portion, and wherein the first heat-insulation member and the second heat-insulation member are exposed at a front of the partition plate.

2. The heat-insulation box according to claim 1, wherein the partition plate further comprises a heat-release part that is placed to be in contact with at least one of the first and second bent portions of the design plate.

3. The heat-insulation box according to claim 1, wherein at least one of the first heat-insulation member and the second heat-insulation member is in a compressed state.

4. The heat-insulation box according to claim 1, wherein the first plate part or the second plate part are only in contact with each other via the heat-insulation material.

5. The heat-insulation box according to claim 1, wherein the heat-insulation material is surrounded by the at least one of the first and second heat-insulation members, the design plate, the first plate part, and the second plate part.

6. The heat-insulation box according to claim 1, wherein the first plate part, the heat-insulation body, and the design plate are stacked.

7. The heat-insulation box according to claim 1, wherein the first plate part, the at least one of the first and second heat insulation members, the design plate, and the heat-release part are stacked.

8. A heat-insulation box, comprising:

a heat-insulation-box main body that has a space;

a door that seals the space; and a partition plate that partitions the space, wherein:

the partition plate comprises:

a design plate that is placed at a side of the door;

a first plate part and a second plate part that are each provided at edges of the design plate;

a heat-insulation material that is located in a region surrounded by the design plate, the first plate part, and the second plate part; and a heat-insulation member that is placed in at least one of a gap between the design plate and the first plate part, and a gap between the design plate and the second plate part, the heat-insulation member comprises a first fiber layer and a second fiber layer, which are made from only fibers without aerogel, and a composite layer including fibers and silica aerogel, and the first fiber layer is provided on a first side of the composite layer and the second fiber layer is provided on a second side opposite to the first side of the composite layer, and wherein one of the first fiber layer and the second fiber layer is in contact with the design plate, the other of the first fiber layer and the second fiber layer contacts the first plate portion or the second plate portion.

9. The heat-insulation box according to claim 1, wherein the design plate is U-shaped.

10. The heat-insulation box according to claim 8, wherein the fiber layer is more deformable than the composite layer.

11. The heat-insulation box according to claim 1, wherein an end surface of the first bent portion and the first heat-insulation member are flush with each other, and an end surface of the second bent portion and the second heat-insulation member are flush with each other.

12. The heat-insulation box according to claim 1, wherein the first heat-insulation member is in contact with only one surface of the first bent portion, and the second heat-insulation member is in direct contact with only one surface of the second bent portion.

13. The heat-insulation box according to claim 8, wherein the first fiber layer and the second fiber layer are made of a fiber material only.

* * * * *